US005373899A

United States Patent [19]

Dore' et al.

[11] Patent Number: 5,373,899

[45] Date of Patent: Dec. 20, 1994

[54] COMPATIBLE FLUID GRAVEL PACKING METHOD

[75] Inventors: Eddie E. Dore'; Frank L. Jones; Danny R. Williamson, all of Balikpapan, Indonesia

[73] Assignee: Union Oil Company of California, Los Angeles, Calif.

[21] Appl. No.: 11,256

[22] Filed: Jan. 29, 1993

[51] Int. Cl.[5] ..... E21B 43/02; E21B 43/116

[52] U.S. Cl. ..... 166/278; 166/51; 166/55.1; 166/297

[58] Field of Search ..... 166/278, 276, 297, 51, 166/55.1

[56] References Cited

U.S. PATENT DOCUMENTS

| | | | |
|---|---|---|---|
| 2,167,190 | 5/1937 | Vietti | 166/21 |
| 2,356,769 | 12/1939 | Layne | 166/26 |
| 2,814,347 | 12/1953 | MacKnight | 166/42 |
| 2,955,653 | 10/1960 | Cain | 166/20 |
| 3,710,862 | 1/1973 | Young et al. | 166/278 |
| 3,760,880 | 9/1973 | Dollarhide | 166/276 |
| 3,850,246 | 11/1974 | Despujols | 166/278 |
| 3,884,301 | 5/1975 | Turner et al. | 166/278 |
| 3,901,318 | 8/1975 | Fortenberry | 166/278 |
| 3,963,076 | 6/1976 | Winslow | 166/278 |
| 4,372,384 | 2/1983 | Kinney | 166/278 |
| 4,378,845 | 4/1983 | Medlin et al. | 166/297 |
| 4,519,451 | 5/1985 | Gray et al. | 166/278 |
| 4,541,486 | 9/1985 | Wetzel et al. | 166/297 |
| 4,549,608 | 10/1985 | Stowe et al. | 166/280 |
| 4,566,538 | 1/1986 | Peterson | 166/278 |
| 4,623,021 | 11/1986 | Stowe | 166/250 |
| 4,645,005 | 2/1987 | Ferguson | 166/278 |
| 4,685,519 | 8/1987 | Stowe et al. | 166/278 |
| 4,817,717 | 4/1989 | Jennings, Jr. et al. | 166/278 |
| 5,027,899 | 7/1991 | Grubert | 166/278 |
| 5,048,608 | 9/1991 | Wiser-Halliday et al. | 166/276 |
| 5,174,379 | 12/1992 | Whiteley et al. | 166/278 |

*Primary Examiner*—Hoang C. Dang
*Attorney, Agent, or Firm*—William O. Jacobson; Gregory F. Wirzbicki

[57] ABSTRACT

The invention controls a well during completion by first running a sealable well completion tool and string downhole from the surface and isolating a productive interval near an oil or gas formation from the remainder of the wellbore. The drilling or other fluid in the interval is displaced from the interval under control by a non-damaging fluid. Using a pressure source from the surface, the non-damaging fluid is pressurized and circulated to move the gravel to the formation face by fluid entrainment. After the gravel is separated from the entraining fluid to form a gravel pack, the oil or gas formation may now be produced through the gravel pack.

23 Claims, 5 Drawing Sheets

COMPATIBLE FLUID GRAVEL PACKING METHOD

FIELD OF THE INVENTION

This invention relates to well drilling devices and processes. More specifically, the invention is concerned with providing tools and an improved method for gravel packing a portion of a wellbore.

BACKGROUND OF THE INVENTION

When excavating a cavity or drilling a wellbore in an underground formation from a surface location, a fluid mixture (e.g., a drilling fluid or mud) at an overbalanced hydrostatic pressure is typically used. An overbalanced pressure is a hydrostatic pressure in excess of the formation pore pressure along the entire length of the open wellbore wall. The overbalanced pressure drilling fluid helps to prevent wellbore wall caving, to consolidate loose formations, and to prevent the intrusion of an unwanted formation fluid, such as a "kick" of gas.

However, the overbalanced pressure drilling fluids also tend to intrude into permeable portions of the formation, such as productive intervals. This intrusion can damage the productive intervals, e.g., a water based drilling fluid causing swelling of a clay containing formation and the resulting loss of permeability. Damage to productive intervals by the drilling fluid may be shallow, e.g., a thin skin effect around the wellbore, or may extend radially deep into the formation.

When completing a well after drilling, e.g., gravel packing and perforating, an overbalanced pressure fluid or "kill fluid" is also typically used in the wellbore. Gravel packing is typically used in unconsolidated sand formations where sand would otherwise be produced along with the formation fluid during production. Perforation is typically used when the production flowrate would be otherwise be unacceptably low. The kill fluid typically used in these completion processes must similarly prevent uncontrolled well-flow and caving of the wellbore during the completion process.

If gravel packing is needed for sand control, the kill fluid also serves to entrain and carry the gravel into the face of the (sandy) formation. The flow of the entraining fluid may be under even greater hydrostatic pressure to move the gravel into the face being packed.

The even greater hydrostatic pressure of the entraining fluid tends to further intrude into and damage the productive intervals of the formation. Damage to the productive intervals may extend even further into the formation if a perforating process creates deep fractures and the entraining fluids are under high (overbalanced) pressure. The highly overbalanced pressure fluid may also fracture or otherwise damage the formation structure which, after removal of the overbalanced pressure, may collapse when the interval is produced at underbalanced pressure.

Although various kill fluid properties may be desirable to control during well completions, density is the most important. The kill fluid density must typically generate a hydrostatic pressure profile in the wellbore greater than the (hydrostatic) pore pressure profile in the formation. Aqueous based or other high density kill fluids and fluid mixtures are typically used.

Other entraining fluids may be more compatible and less damaging to a productive interval, but may not have adequate density to be used safely, e.g. light oil-based fluids for an oil bearing productive interval would require large quantities of light oil under very high surface pressures. Mixing these light oil fluids with other fluids may provide the desired density, but sacrifice viscosity, compatibility, or other desired properties of an entraining fluid.

SUMMARY OF THE INVENTION

Such fluid density and formation damage problems are avoided in the present invention by isolating the productive interval zone of the wellbore. A separate, less dense entraining fluid is used in the isolated productive interval without displacing the more dense kill fluid in the remainder of the wellbore. The pressure, viscosity, compatibility, and other properties of the entraining fluid can be controlled without the primary concern for maintaining a high fluid density. In the preferred embodiment, a formation fluid which is less dense than the kill fluid is at least in part used as the entraining fluid, assuring fluid compatibility with the formation.

One embodiment of the invention sets upper and lower packers at the zone of interest within a cased wellbore. A tubing conveyed tool (capable of isolating a producing zone between the packers) is run downhole from the surface and set in the production zone forming an annulus between the tubing and the wellbore. When in place, a productive interval is sealed (or packed) off from the remainder of the ring-like space or annulus within the wellbore, typically containing a kill fluid. The casing of the wellbore is then perforated over the interval of interest by tubing conveyed perforating guns mounted near the bottom of the tubing conveyed tool. The wellbore pressure is underbalanced at this point in the process. Non-damaging fluid is flowed from the formation in the perforated zone through the tool and the tubing string, removing the perforating debris and cleaning the perforations. The tool is repositioned after perforating and formation fluid flowing but prior to gravel packing. Using a pressure source, the non-damaging fluid in the tubing is pressurized and circulated in the zone to carry and pack the gravel. The tubing conveyed tool is moved by pulling it from the well after gravel packing, allowing a flapper valve in the tool to shut. This isolates the productive gravel packed zone from the kill fluid above it. A completion tubing string is run and the well is then produced.

BRIEF DESCRIPTION OF THE DRAWINGS

In these Figures, it is to be understood that like reference numerals refer to like elements or features.

DETAILED DESCRIPTION OF THE INVENTION

Figure 1:
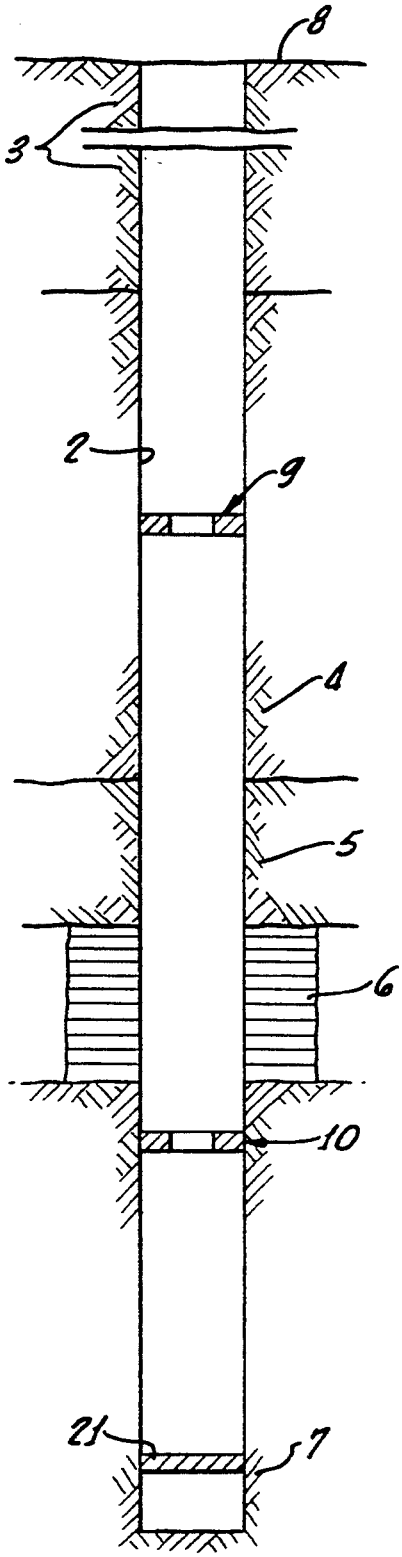
FIG. 1 shows a schematic cross-sectional view of a wellbore.

FIG. 1 shows a cross-sectional view of wellbore 2 drilled through various formations and layers 3–7 below surface 8. The layer of interest 6 is expected to be oil and/or gas producing. An upper packer 9 and a lower packer 10 are set in wellbore 2. The wellbore zone between the upper and lower packers 9 and 10 defines the zone of interest at or near the oil producing layer 6.

Packers 9 and 10 may be of various designs. One embodiment uses a polished interior seal. An example of this type of packer is a SC-1L, available from Baker Sand Control Inc., located in Houston, Tex. Other types and commercially available packers can be used, including the Versa-Trieve available from Otis Inc., located in Dallas, Tex.

Although the previously drilled wellbore 2 is shown cased and substantially vertical and the productive layer 6 is shown substantially horizontal, the process can be applied to other configurations. These configurations include open wellbores, non-vertical cavities and wellbores, and non-horizontal layers or formations. Productive layer 6 in this example will be assumed to require perforating prior to gravel packing, but the two fluid and isolating process described herein can be applied to other completion applications.

The cased wellbore 2 substantially contains a fluid, such as a drilling mud mixture or a "kill" fluid. A kill fluid typically comprises a mixture of water and a salt such as KCl. The water mixture has a relatively high density which assures that an overbalanced pressure will be present throughout the length of the wellbore. The high density and gel strength of the mixture also tend to control the flow to/from any formation penetrated by the wellbore. However, the high density fluid may also result in a "skin" (i.e., a thin layer) or other damage to the permeability of a producing layer.

Density of the "kill" fluid mixture can typically range from about 7.0 to as much as 18.0 lb/gal (833 to 2142 kg/m$^3$), but more typically will have a density less than about 9.5 lb/gal (1130.5 kg/m$^3$) for conventional wells. The drilling fluid density for other types of wells, such as those drilled from off-shore platforms, is typically similar, but may range beyond these values.

Figure 2:
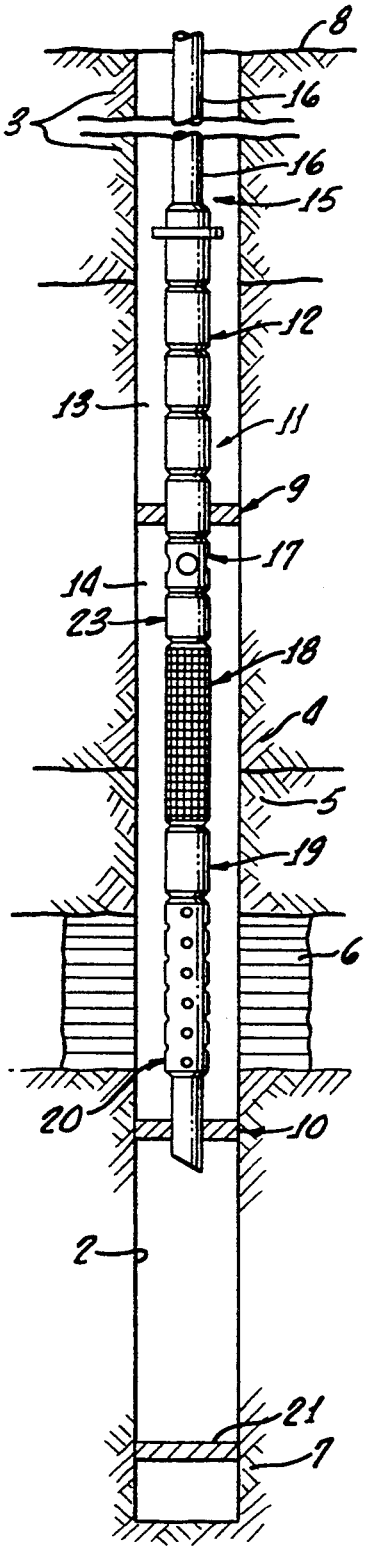
FIG. 2 shows the wellbore as shown in FIG. 1 with a completion tool in place just prior to perforating a layer of interest.

FIG. 2 shows a completion tool 11 being run into the wellbore 2 shown in FIG. 1. In the initial position shown, the bottom portion of the outer diameter of an extended upper seal assembly 12 engages the polished interior of the upper packer 9, producing a fluid restriction or seal between the annulus space 13 above the upper packer 9 and the annulus space 14 below the upper packer 9. Above the upper seal assembly 12 of the completion tool 11 is a running tool 15 and an attached tubing 16 extending towards the surface 8. Below the upper seal assembly 12 is a flow diverter 17, a gravel pack screen 18, a lower seal assembly 19, and tubing conveyed perforating (TCP) gun assembly 20. The TCP gun assembly 20 is shown positioned proximate to the productive layer 6.

A plug 21 blocks fluid movement in the wellbore 2 below the plug 21. If flow diverter 17 is closed, the upper packer 9 blocks fluid movement from above the upper packer 9, forming a fluid containment or isolation zone between the upper packer and plug 21. Flow diverter 17 can be partially or fully opened to allow fluid from the containment zone to flow up towards the surface 8 or fluid from the surface to flow into the containment zone. The pressure of the fluid in the containment zone can also be controlled from the surface 8. A choke (not shown) or other flow control means can also be provided in the tubing 16 if additional flow control is required.

Figure 3:
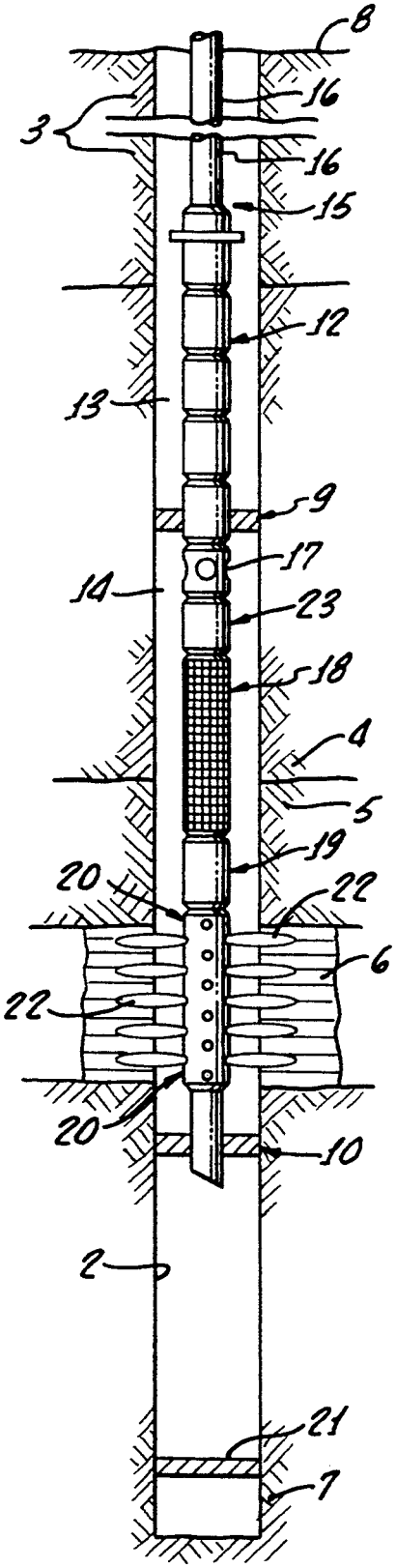
FIG. 3 shows the wellbore as shown in FIG. 2 after perforating.

FIG. 3 shows the assembly 11 and wellbore 2 as shown in FIG. 2 after the TCP gun assembly 20 has been fired or actuated. The wellbore (casing and penetrated formation) 2 has been perforated by the TCP guns producing fluid flow paths 22 which cut deep into the productive formation 6. Average pressure in the containment zone is controlled to a value lower than the average formation pressure, allowing formation fluid (e.g., oil and/or gas from the perforated flow paths 22) to displace the wellbore fluid in the containment zone. The displaced wellbore fluid flows up the tubing 16 towards the surface 8. Once the wellbore zone has been isolated and/or fluid in the zone has been displaced by oil and/or gas, another compatible fluid can also be introduced into the containment zone through tubing 16.

The fluid displacement step can also be used to flow test the perforated interval of the formation. The displacing or formation fluid may also flow through a ported sub (not shown) which is located above the TCP gun assembly 20 and below the lower seal assembly 19. Various flow controls may also be placed in the flow path and the flowrates measured by a flowmeter (not shown) and/or recorded. Test flowrates may be stepped, that is, be initially small and incrementally increased. Test flow controls may also have to initially compensate for pressure differences caused by the displacement of the heavier first fluid in the wellbore 2 by the lighter second fluid, e.g., oil and/or gas formation fluids.

Figure 4:
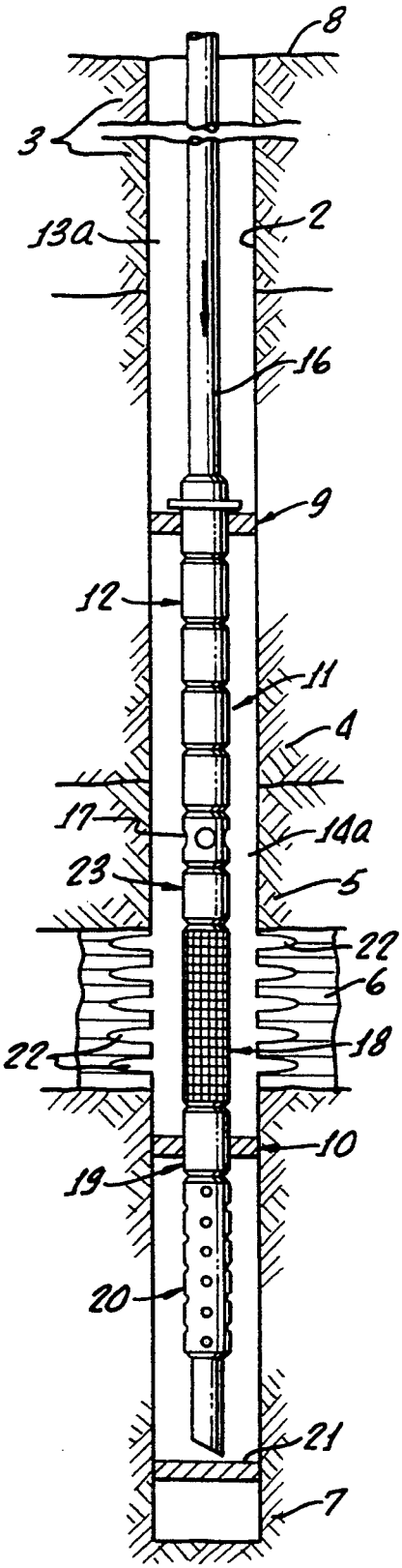
FIG. 4 shows the wellbore as shown in FIG. 3 after the completion tool is repositioned to gravel pack the zone near the layer of interest.

FIG. 4 shows the assembly 11 shown in FIG. 3 after further running the assembly 11 into the wellbore 2. The further running (shown by arrow) latches the upper seal assembly 12 into upper packer 9. The lighter fluid contained below upper packer 9 in annulus **14*a* can be maintained fluidly isolated and under pressure during the further running because of the sliding seals and extended length of the upper seal assembly 12**.

In the lower position of assembly 11 shown, lower packer 10 now engages the lower seal assembly 19. This engagement restricts fluid flow and reduces the volume of fluid that is contained, i.e. the fluid below lower packer 10 and outside the tool 11 can be separated from the fluid in the annulus **14*a*. In this position, the gravel pack screen 18 is now also proximate to the perforated layer 6. The repositioned tool 11** can now be prepared for gravel packing.

Figure 5:
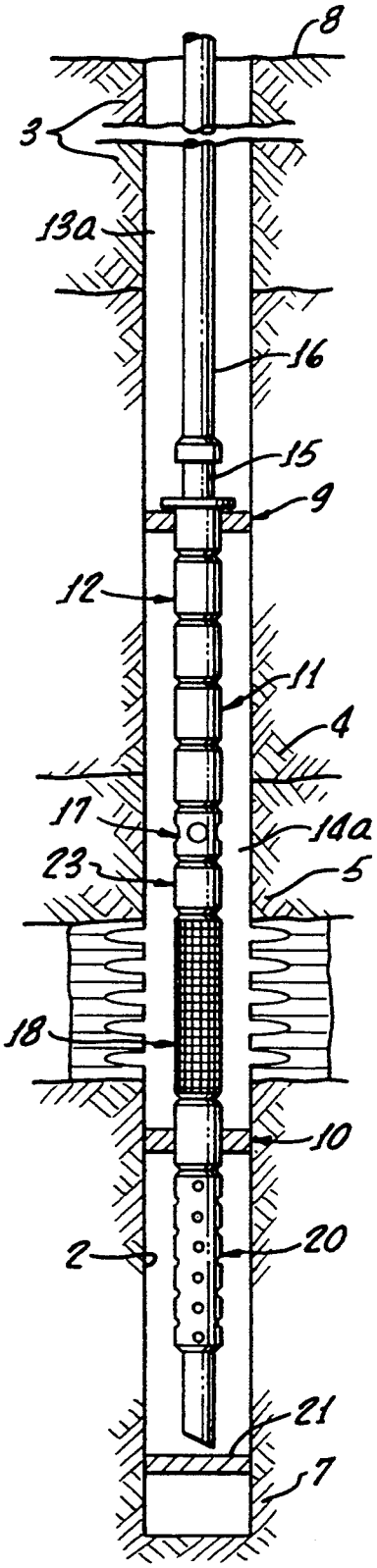
FIG. 5 shows the wellbore as shown in FIG. 4 after flow diverting to begin gravel packing.

FIG. 5 shows the running tool 15 repositioned to allow the gravel to be entrained by a lighter second fluid flowing through flow diverter 17. Running tool diverter 15 is shown lifted to the new position by tubing 16, but it will be understood by those in the art that repositioning of the running tool diverter 15 may be accomplished by rotation or other means.

Figure 6:
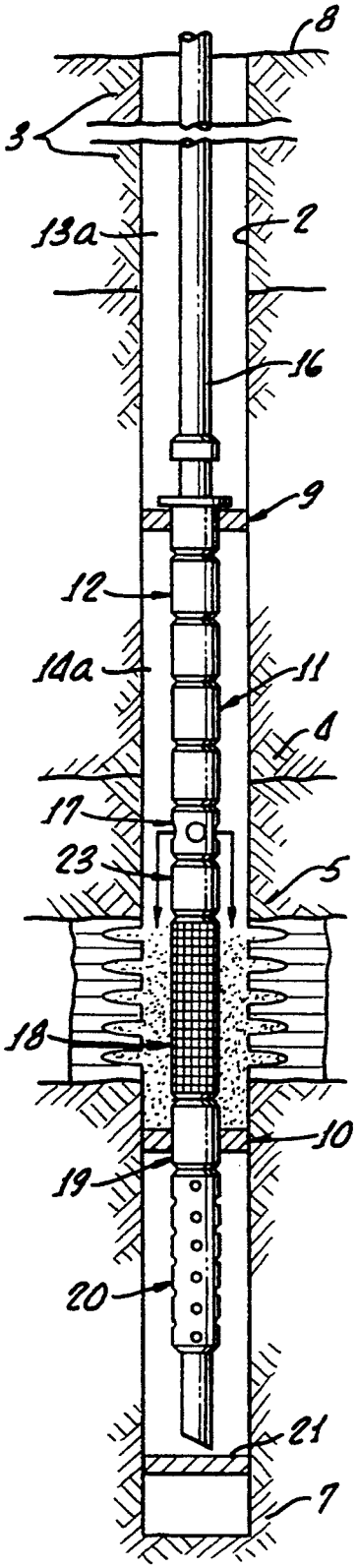
FIG. 6 shows the wellbore as shown in FIG. 5 during gravel packing.
Figure 7:
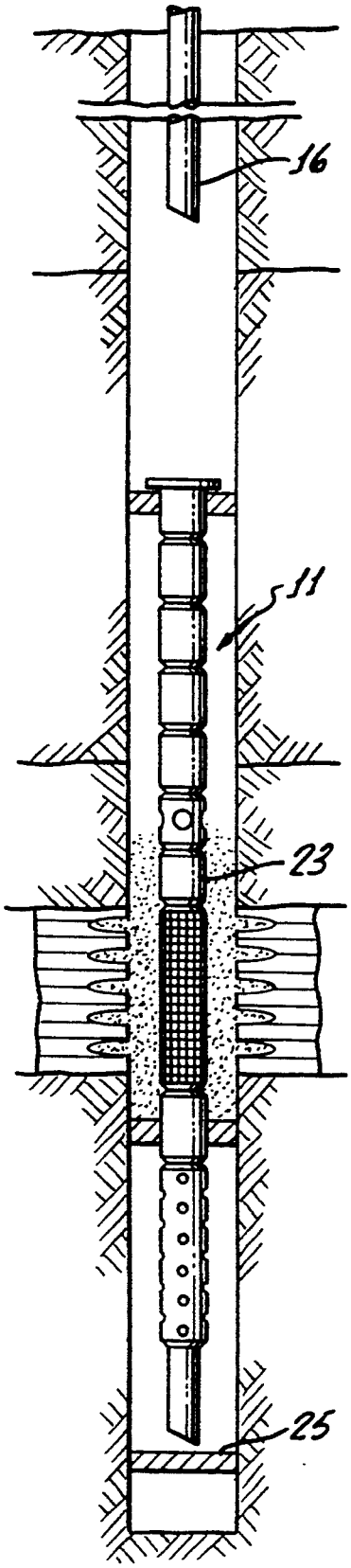
FIG. 7 shows the wellbore as shown in FIG. 6 after gravel packing.
Figure 8:
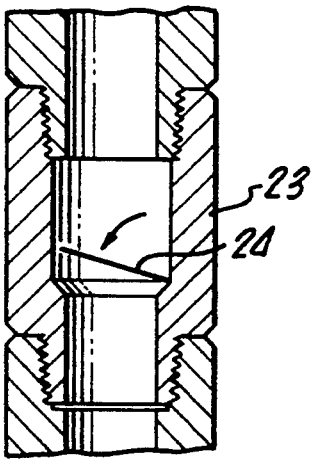
FIG. 8 shows a partial cross-sectional view of a check valve portion of the completion tool.

Tubing 16 extends as a stinger inside the tool 11 through a check valve 23. When propped open by the stinger portion of the tubing 16, check valve 23 allows fluid flow from the upper portion of the tool to be conducted to the lower portion of the tool during lighter fluid circulation and gravel packing (as shown in FIG. 6). When the stinger portion of the tubing 16 is removed from the check valve 23 (as shown in FIGS. 7 and 8), fluid flow tending to blow out the gravel screen 18 is prevented.

FIG. 6 shows the assembly during gravel packing using a flow of formation compatible fluids to entrain the gravel. The compatible fluid may be the formation fluid previously produced, or it may be a diesel fuel supplied from the surface or other non-formation damaging fluid.

Density of a compatible fluid can vary widely. For example, diesel fuel can typically range from about 6.8 to 7.2 lb/gal (809.2 to 856.8 kg/m$^3$). The drilling fluid density for other types of compatible fluids, such as brine/oil, may typically be as little as about 7.0 lb/gal (833 kg/m$^3$), but more typically will at least 8.4 lb/gal (999.6 kg/m$^3$). Although the density of the compatible fluid is not required to be less than the density of the "kill" fluid, the compatible fluid density is typically less dense than the kill fluid. The density of the compatible fluid is also typically less than what is required to maintain an overbalanced pressure along the wellbore. If the compatible fluid is a (produced) formation fluid, its density can also vary widely but will typically have a density of no more than 7.0 lb/gal for oil and/or gas formations.

The compatible fluid is pressurized (e.g., by pumps at the surface) and conducted through tubing 16 (as shown by arrow within tubing 16) and tool 11 to the zone near the productive layer 6 in order to cause a return flow of compatible fluid, to prevent further formation fluid inflow and to entrain gravel. Although the pressure is typically below formation fracturing pressure, if hydraulic fracturing of the formation is also desired, pressures exceeding the formation fracture pressure would be used. The gravel to be entrained is typically located in a line gravel blender (not shown) above the tool assembly, but may be located within the tool assembly, at the surface, or at other locations. When the compatible fluid mixture exits through flow diverter 17 into the annulus 14*a*, it carries the entrained gravel to the perforated area as shown. Although some of the entraining fluid flows into the formation, another portion may flow through the gravel screen 18. The entrained gravel is separated or prevented (e.g., screened out) from continuing with the entraining fluid into the formation or screen, resulting in a packing of the gravel in the zone (at annulus 14*a*).

FIG. 7 shows the tubing (and stinger) 16 being removed from the tool 11 after gravel packing. Removal of the tubing (and stinger) 16 allows the check valve 23 to close preventing the transfer of (non-compatible) kill fluid above the check valve to the gravel packed zone.

FIG. 8 is shows a schematic of the check valve 23. In the absence of a stinger or other impediment to closing, a flapper 24 is biased closed (as shown by arrow) by a spring or other biasing means. The check valve prevents downward flow, but allows upward flow or production from the formation.

Figure 9:
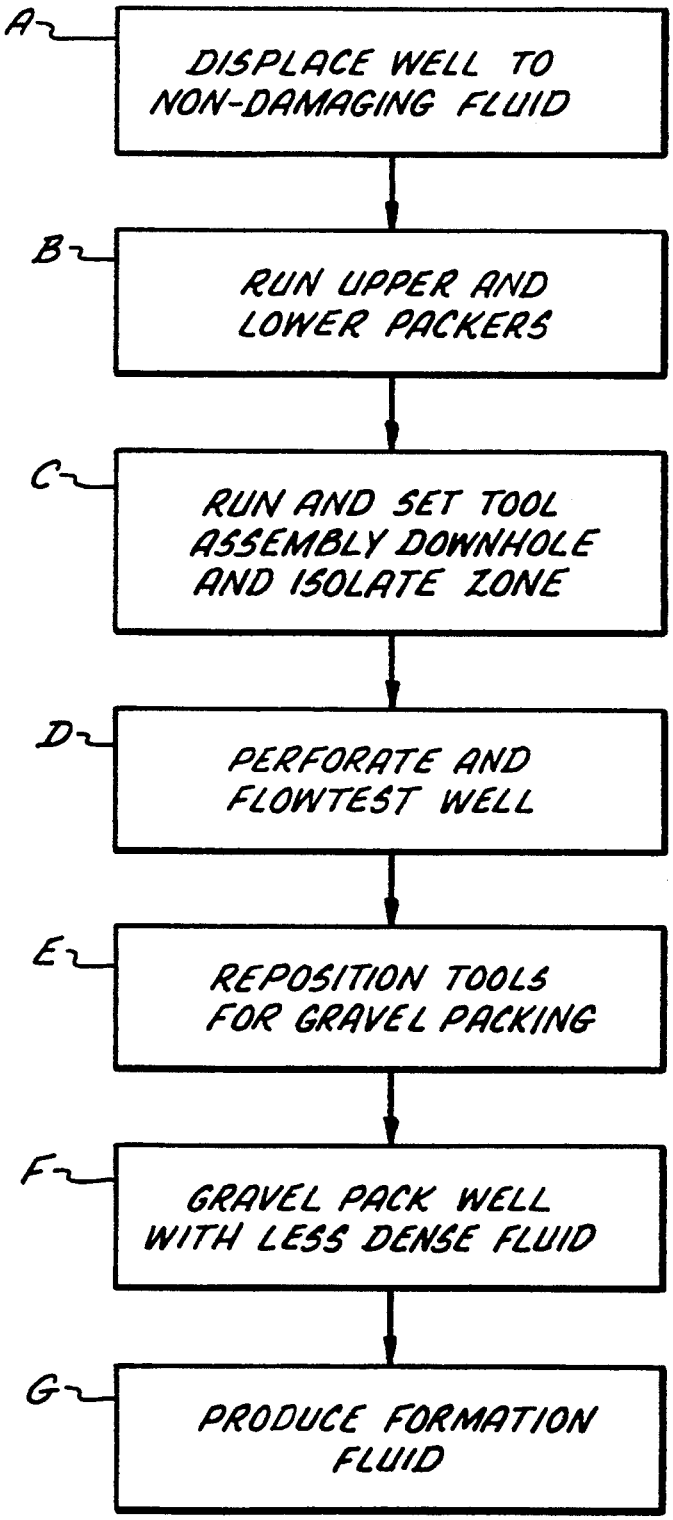
FIG. 9 shows a flow chart of the process.

FIG. 9 shows a process flow chart of the method as applied to a cased and unperforated wellbore. Step "A" of the process displaces the wellbore kill fluid with a non-damaging fluid, e.g., diesel oil. Since the wellbore in this application is a closed container (cased off with no perforations), the non-formation damaging fluid does not need to control formation fluid in-flow and pressure; therefore, the fluid can be less dense than the kill fluid.

Step "B" of the process runs and sets the lower (sump) packer 10 and the upper (isolation) packer 9 shown in FIG. 1. The packers may be run and set using an electric line or on a (tubular) work string.

Step "C" of the process runs the tool assembly (similar to the tool assembly 11 shown in FIG. 2). The assembly in this application includes (from bottom to top) tubing conveyed perforating guns 20, a ported sub (not shown in FIG. 2), the lower seal assembly 19, the gravel pack screen 18, the flow diverter 17, the upper seal assembly 12, and the running tool 15, all supported by the tubing 16. The tool assembly is run into the wellbore until the tubing conveyed perforating guns 20 are opposite the zone of interest. The tool assembly and packers 9 & 10 (as shown in FIG. 2) isolate the fluid in the annulus 14 from the remainder of the fluid in the wellbore annulus 13.

Step "D" perforates the wellbore and flows formation fluids into the annulus 14 (as shown in FIG. 2). The perforating step fires the TCP guns creating the paths 22. The flowing of formation fluids acts as a flowtest of the perforated producing zone. Although a partial first fluid displacement is possible, the formation fluids produced typically displace most of the fluid in the annulus 14, in the tool assembly, and in the tubing for the preferred embodiment. The flowtest also typically removes some of the perforating debris by entrainment and cleans up the perforation paths or tunnels 22 (as shown in FIG. 3). The entrained solid debris particles are expected to vary widely in size and shape and are not expected to comprise more than a few percent by weight of the displacing or formation fluid, preferably less than one percent by weight, most preferably less than 0.5 percent. The produced formation fluid that remains in the tool assembly 11 can be used as the gravel entraining fluid during gravel packing operations in Step "F" hereinafter described. In order to maintain control of the well and (later) gravel packing, the fluid pressure in the tubing 16 at the surface is typically increased after perforating, formation fluid flowing, and displacing of the initial fluid.

After perforating and flowtesting the well in step "D," step "E" repositions the tool assembly 11 into a position for entraining and packing gravel. Although in the embodiment shown, the repositioning slides the upper seal assembly 12 through the upper (isolation) packer 9 shown in FIG. 2, the repositioning while maintaining fluid isolation may also be accomplished by means of packers with seal elements as an integral part of the assembly or other means.

Step "F" carries gravel by entraining it in a flow of the formation fluid produced during the flowtest in step "D" and/or a flow of the non-formation damaging fluid used in step "A." The gravel/fluid mixture exits from inside the tool to outside the tool near the wellbore zone to be packed.

Once the suspended or entrained gravel reaches the wellbore zone to be packed, the gravel is separated from the entraining fluid. The separation of the gravel is at least in part accomplished by the screen 18 (in the embodiment shown in FIG. 2) or other positive means, but may also be accomplished or aided by changing fluid flow characteristics, such as settling of the gravel from a lower fluid stream velocity.

Typically, gravel packing results from a combination of entraining and separating effects near the perforated wellbore wall. As the fluid mixture, such as formation fluid and gravel, flows back into the formation, the radial flow velocity slows (allowing settling) and the wellbore wall (the holed casing and sandy formation) mechanically prevents the gravel from continuing into the formation. Because of the several separation mechanisms, only a limited amount of fluid is needed to entrain, settle and/or pack the gravel in the zone of interest. In some cases, the total amount of fluid needed for gravel entraining and packing is less than is contained in the annulus 14, tool assembly 11, and tubing 16 (as shown in FIG. 2).

The size of the solid particles used in the gravel packing varies depending primarily upon the sand size in the layer of interest or formation the well is completed in. It will be understood in the art that the solid gravel particles may be sand, bauxite, ceramic beads, or other materials. In addition to gravel particles, proppants may also be included if formation fracturing is expected. Although the size range of gravel particles that can be used is essentially unlimited, practical considerations typically limit the gravel size range from about 40/100 to 6/10 US Standard mesh size. The fluid flow velocity and the selection of the gravel size used may also depend upon the properties of the formation and compatible fluids used for entraining, e.g., a less dense and less viscous entraining fluid.

Although the maximum and minimum compatible fluid pressure near the surface during gravel packing is theoretically unlimited, the pressure will typically be significantly greater than surface fluid pressures in conventional gravel packing methods. The added surface fluid pressure is needed to compensate for a decreased hydraulic head generated by the typically less dense compatible fluid. For example, for a wellbore extending to about 5000 feet (1525 meters) below the surface, instead of surface pressures typically ranging from about 500 to 1000 psia (34.0 to 68.0 atm) for conventional gravel packing methods using heavy "kill" fluids, surface pressures using a lighter compatible fluid typically ranges from about 800 to 1290 psia (54.4 to 87.8 atm). For a production zone that is at a nominal depth of 5000 feet (1525 meters), a surface pressure increase of about 300 to 400 psi (20.4 to 27.2 atm) static pressure is typical for the present method when compared to conventional methods.

Step "G" then produces formation fluids at the surface through the packed gravel. Although this formation fluid production may again be accomplished through the tubing 16 (as shown in FIG. 2), the tubing is first removed and replaced with a production string in the preferred embodiment. The production string may also include means for pumping the formation fluid.

An alternative embodiment of the apparatus or tool 11 includes at least one inflatable packer instead of the lower packer shown in FIG. 1. For example, the lower packer 10 and bottom seal assembly 19 would be replaced with an inflatable packer attached to the bottom portion of the tool 11. The inflatable packer would be inflated after the gravel screen 18 was located proximate to the perforated layer 6.

Another alternative embodiment of the tool 11 deletes the TCP gun assembly gun 20 (shown in FIG. 2) or other perforating means. This alternative tool might be used in open hole completions where perforating is not required. Since repositioning is not required, this alternative tool would also avoid the need for the extended upper seal assembly 12 (or other multi-position sealing means) and the sliding upper packer 9 (e.g., an inflatable upper packer could be used). If the producing zone is near a lower plug (see plug 25 on FIG. 7) or the well bottom, this alternative embodiment may also avoid the need for a lower packer and lower seal assembly. The gravel screen 20, check valve 23, and flow diverter 17 as shown in FIG. 2, may also be deleted, e.g., if the gravel entraining fluid is all injected into the formation.

A process for using this alternative non-perforating tool in an open hole wellbore is to:

(1) place the tubing conveyed tool for gravel packing in an open hole wellbore containing the first fluid;

(2) isolate a wellbore zone near a producing layer from most of the remainder of the wellbore, e.g., packing off the wellbore with an upper packer;

(3) displace most the first fluid from the zone with a less dense second fluid, e.g., lowering the pressure and flowing (lighter) formation fluids into the zone and into the tool and tubing;

(4) increase the fluid pressure near the surface and flowing the second fluid (and/or a compatible fluid from the surface) at a flowrate sufficient to entrain gravel and transport it towards the producing layer; and (5) separate the gravel from the entraining fluid flow near the face of the producing layer within the wellbore.

The compatible fluid from the surface is expected to mix with the formation fluid and may include viscosity enhancers to more efficiently entrain the gravel. The resulting separated gravel packs the wellbore near the producing layer, allowing increased production of fluids from the layer through the gravel packing.

Still other alternative embodiments are possible. These include: a plurality of gravel screens and/or perforating gun assemblies; providing a concentric tubing string within tubing 16 such that fluid circulation can be achieved without displacing fluid in the annulus 13, a tool composed of acid resistant materials and replacing the perforating step with an acid treatment step; and replacing the perforating step with a fracturing step.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A process for moving gravel particles from a gravel source to near a productive zone within a subsurface wellbore, said wellbore extending from a surface to a subsurface formation and substantially containing a wellbore fluid, said process comprising:

running a gravel packing tool within said wellbore to said productive zone, wherein said tool is fluidly connected to a tubing extending towards the surface and wherein said tubing and wellbore form a non-productive annulus substantially outside said productive zone;

isolating said productive zone from said annulus so that fluid flow is restricted between said zone and said annulus;

displacing at least a portion of said wellbore fluid in said productive zone with a displacing fluid from a source having a different composition than said first fluid, said displacing fluid from said source being substantially free of gravel particles;

entraining gravel particles within said displacing fluid which displaced said wellbore fluid to form a slurry;

introducing said slurry into said productive zone; and separating said particles from said slurry substantially within said productive zone wherein said separated particles form a gravel packing, wherein said displacing fluid comprises a fluid derived from said formation.

2. A process for moving gravel particles from a gravel source to near a productive zone within a subsurface wellbore containing a wellbore fluid, said process comprising:

running a gravel packing tool within said wellbore towards said productive zone, wherein said tool is fluidly connected to a tubing extending towards the surface and wherein a portion of said tubing and wellbore form a non-productive annulus substantially outside said productive zone;

isolating said productive zone from said annulus so that fluid flow is restricted between said zone and said annulus;

displacing at least a portion of said wellbore fluid in said productive zone with a displacing fluid at least in part derived from said productive formation;

entraining gravel particles within said displacing fluid to form a slurry;

introducing said slurry into said productive zone; and separating said particles from said slurry substantially within said productive zone wherein said separated particles form a gravel packing.

3. The process of claim 2 which also comprises the step of repositioning said tool after said running step and before said displacing step.

4. The process of claim 3 which also comprises the step of perforating the walls of said wellbore after said running step and before said repositioning step.

5. The process of claim 4 wherein said introducing step also comprises at least partial displacing of said wellbore fluid within said wellbore with said displacing fluid.

6. The process of claim 5 wherein said partial displacing displaces a majority of said wellbore fluid within said wellbore.

7. The process of claim 6 wherein said wellbore fluid comprises a water and salt mixture having a density of at least about 8.4 lb/gal and wherein said displacing step displaces a majority of said wellbore fluid within said productive zone with said displacing fluid.

8. A process for moving gravel particles from a gravel source to near a productive zone within a subsurface wellbore, said wellbore extending from a surface to a subsurface formation and substantially containing a wellbore fluid, said process comprising:

running a gravel packing tool within said wellbore to said productive zone, wherein said tool is fluidly connected to a tubing extending towards the surface and wherein said tubing and wellbore form a non-productive annulus substantially outside said productive zone;

isolating said productive zone from said annulus so that fluid flow is restricted between said zone and said annulus;

displacing at least a portion of said wellbore fluid in said productive zone with a displacing fluid from a source having a different composition than said first fluid, said displacing fluid from said source being substantially free of gravel particles wherein the density of said wellbore fluid is greater than the density of said displacing fluid, said displacing fluid within said wellbore having a hydrostatic and surface pressure components of total fluid pressure, wherein said wellbore fluid comprises a water and salt mixture having a density of at least about 8.4 lb/gal and wherein said displacing step displaces a majority of said wellbore fluid within said productive zone with said displacing fluid;

entraining gravel particles within said displacing fluid which displaced said wellbore fluid to form a slurry, wherein said displacing fluid comprises a fluid derived from said formation and having a density of no more than about 7.0 lb/gal and wherein said displacing step displaces substantially all of said wellbore fluid within said productive zone with said displacing fluid without displacing substantially all of said wellbore fluid from said annulus;

introducing said slurry into said productive zone, wherein said introducing step also comprises at least partial displacing of said wellbore fluid within said wellbore with said displacing fluid and wherein said partial displacing displaces a majority of said wellbore fluid within said wellbore;

separating said particles from said slurry substantially within said productive zone wherein said separated particles form a gravel packing;

increasing the surface pressure component of said displacing fluid within productive zone after said displacing step such that the total pressure does not exceed formation fracture pressure;

producing formation fluids through said gravel packing;

repositioning said tool after said running step and before said displacing step; and perforating the walls of said wellbore after said running step and before said repositioning step.

9. The process of claim 8 wherein said displacing fluid also comprises an oil based fluid supplied from a source located on said surface and wherein said displacing step also mixes the formation derived fluid with the oil based fluid.

10. The process of claim 9 wherein said introducing step also comprises flowing at least a portion of said displacing fluid back towards said surface.

11. The process of claim 10 wherein a displacing fluid pressure is present within said productive zone during said displacing step and which also comprises the step of increasing the static pressure present in said productive zone after said displacing step.

12. The process of claim 11 wherein said displacing fluid pressure is less than the pore pressure within the subsurface formation at a similar location under the surface and wherein said pressure increasing step increases the pressure within said productive zone to greater than the formation pore pressure but less than formation fracture pressure.

13. The process of claim 12 wherein said productive zone is located at least 5000 feet below said surface and wherein said displacing step also substantially fills said tubing with said displacing fluid.

14. The process of claim 13 wherein the static pressure within said tubing near said surface and wherein said pressure increasing step increases the static pressure near said surface by at least about 300 psi.

15. A process for placing solid particles from a particle source into a portion of a cavity substantially containing a first fluid which comprises:

placing a fluid conduit in said cavity wherein an annulus is formed between said conduit and said cavity;

restricting fluid flow between said cavity portion and said annulus;

displacing at least some of said first fluid in said cavity portion with a second fluid wherein said second fluid comprises a fluid derived from said formation, wherein said displacing does not displace a substantial portion of said first fluid in said annulus;

entraining said particles from said particle source within said second fluid to form a slurry;

transporting said slurry to said cavity portion; and separating a substantial portion of said particles from said transported slurry within said cavity portion.

16. The process of claim 15 wherein the density of said first fluid is greater than the density of said second fluid and wherein the average fluid pressure within said cavity portion during said displacing step is less than the average pressure within said cavity portion during said entraining step.

17. The process of claim 16 wherein the cavity is a wellbore penetrating a subsurface formation having a pore pressure which varies as a function of the location within said wellbore and wherein said average pressure within said cavity portion during said displacing step is less than the average of said pore pressures proximate to said cavity portion, and wherein said average pressure within said cavity portion during said entraining step is greater than said average of said pore pressures proximate to said cavity portion.

18. An apparatus for placing gravel particles from a gravel source into a lower section of a subsurface wellbore substantially containing a wellbore fluid penetrating a formation below a surface, said apparatus comprising:

a tubular duct extending from an upper end to a lower end which is proximate to said section when said duct is within said wellbore and wherein an annulus is created between said duct and said wellbore;

a gravel packing tool fluidly connected to said tubing near said lower end;

means for fluidly isolating said section from said annulus;

means for displacing at least a portion of said wellbore fluid within said section with a displacing fluid comprising a fluid derived from said formation without displacing most of said wellbore fluid in said annulus;

means for entraining said gravel particles within said displacing fluid from said gravel source and transporting said entrained gravel to said section; and means for separating said gravel particles from said displacing fluid within said section.

19. The apparatus of claim 18 which also comprises:

means for perforating said wellbore attached to said tubular duct and said means for entraining, said perforating means located proximate to said means for entraining;

means for moving said perforating means into said section; and second means for moving said entraining means into said section while maintaining said annulus substantially fluidly isolated from said section.

20. The apparatus of claim 19 which also comprises:

pump means for increasing the pressure on said displacing fluid within said section after displacement of said wellbore fluid; and means for producing formation fluids through the separated gravel from the formation to the surface.

21. The apparatus of claim 20 wherein said means for fluidly isolating comprises a packer set within said wellbore above said section and wherein said displacing, entraining, and separating means comprise a gravel packing tool attached to said tubular duct.

22. The apparatus of claim 21 wherein the size of said gravel ranges from about 40/100 to 6/10 U.S. Standard mesh size and said means for perforating comprises a tubing conveyed perforating gun assembly.

23. A process for perforating a wellbore near a subsurface formation and moving gravel particles from a subsurface gravel source to a productive zone within the subsurface wellbore, the wellbore extending from a surface to the subsurface formation and substantially containing a wellbore fluid, said process comprising:

running a perforating and gravel packing tool within said wellbore to said productive zone, wherein said tool is fluidly connected to a tubing string extending towards the surface and wherein said tubing string and wellbore form a non-productive annulus substantially outside said productive zone;

isolating said productive zone from said annulus so that fluid flow is restricted between said zone and said annulus;

perforating the walls of said wellbore after said isolating step;

repositioning said tool substantially within said zone after said perforating step;

displacing substantially all of said wellbore fluid in said productive zone with a formation fluid of different composition and a lesser density than said wellbore fluid;

increasing the pressure on the displaced formation fluid within said productive zone after said displacing step;

entraining gravel particles from said source within said displaced formation fluid to form a slurry;

introducing said slurry into said productive zone;

separating said particles from said slurry substantially within said productive zone wherein said separated particles form a gravel packing; and producing formation fluids through said gravel packing.

* * * * *